US006089162A

United States Patent [19]

Madison

[11] Patent Number: 6,089,162

[45] Date of Patent: Jul. 18, 2000

[54] RAIL VEHICLE FOR TIE LOADING AND UNLOADING

[75] Inventor: Harry Madison, Memphis, Tenn.

[73] Assignee: Harsco Technologies Corporation, Fairmont, Minn.

[21] Appl. No.: 09/125,126

[22] PCT Filed: Dec. 11, 1997

[86] PCT No.: PCT/US97/23156

§ 371 Date: Aug. 11, 1998

§ 102(e) Date: Aug. 11, 1998

[87] PCT Pub. No.: WO99/29962

PCT Pub. Date: Jun. 17, 1999

[51] Int. Cl.[7] ..... E01B 29/00

[52] U.S. Cl. ..... 104/2; 104/5; 414/339; 414/341

[58] Field of Search ..... 104/2, 5, 7.1, 9, 104/12; 414/339, 340, 341

[56] References Cited

U.S. PATENT DOCUMENTS

| | | | |
|---|---|---|---|
| 4,236,452 | 12/1980 | Theurer et al. | 104/2 |
| 4,829,907 | 5/1989 | Theurer et al. | 104/5 |
| 4,911,599 | 3/1990 | Theurer et al. | 104/5 |
| 5,222,435 | 6/1993 | Theurer et al. | 104/2 |
| 5,357,867 | 10/1994 | Theurer et al. | 104/2 |
| 5,467,717 | 11/1995 | Theurer . | |
| 5,511,484 | 4/1996 | Theurer et al. | 104/2 |

*Primary Examiner*—Mark T. Le

*Attorney, Agent, or Firm*—Arnold B. Silverman; David C. Jenkins; Eckert Seamans Cherin & Mellott, LLC

[57] ABSTRACT

A railway maintenance vehicle exchanges worn crossties for new ones. Worn ties are collected and stored in open-top gondola cars, preferably progressing longitudinally. New ties are simultaneously unloaded from the gondola cars for distribution along the-track. Flange-wheeled tie transport vehicles such as a mobile crane and a bundle clasping transport travel on rails atop the gondola cars to move worn and new ties between collection and distribution devices and the respective storage and unloading locations. Gaps between the cars are bridged by hinged telescoping rail sections. The travel distance between the storage or unloading location and the collection or distribution points change over time. To improve efficiency, at least one intermediate temporary storage basket is moved along the cars and can be passed over by the transport vehicles. The basket is used, preferably with a third tie transport vehicle, to assist in handling bundles and to shorten the trip of the first or second transport for collection or delivery. The basket is particularly useful for accumulating a bundle of new ties for pickup by a bundle grappling transport vehicle. The vehicle can be limited to collecting and storing worn ties left on the rails by a preceding tie extractor, and dropping off new ties, or can incorporate tie extraction and/or tie insertion devices as well.

17 Claims, 13 Drawing Sheets

RAIL VEHICLE FOR TIE LOADING AND UNLOADING

BACKGROUND OF THE INVENTION

The invention generally relates to a rail vehicle and method for installation and removal of railroad crossties or sleepers. A tie exchanging apparatus extracts and loads old ties, and unloads and installs new ties. The apparatus comprises at least one tie distribution car, a tie collection car and a storage car, each having interconnected guide rails bridging between cars, permitting a tie loading vehicle and a tie transport vehicle to move from car to car. The tie loading vehicle transfers ties from the storage cars to a storage basket which is structured to fit removably in a gondola car for temporarily holding a number of ties. The transport vehicle engages the basket and transfers it over the guide rails to an active location along on the tie exchanging vehicle where the ties are unloaded and distributed or collected for storage.

Railways comprise a bed of ballast material, such as size four stones, in which ties are embedded and support rails laid thereupon at a specific gauge width. The rails are set on tie plates and fastened to the ties by anchors and spikes, clips or the like. In the U.S., rail ties are usually made of wood or a similar material that absorbs shock as trains pass, although concrete ties are also used. As trains pass over, the rails are subjected to compressive and shearing forces that tend to loosen the spikes and anchors from the ties over time. Wooden ties also weather, becoming dry and brittle. Eventually, ties fatigue and fracture under the stresses imposed, and accordingly it is necessary to replace the ties regularly. All the ties along a section of the railway may be changed, or only selected ties.

Replacing rail ties is a formidable task. The rails are disengaged from the ties to be replaced by removing their spikes. For full tie replacement, the tracks are lifted and rethreaded onto the new ties. In any event, the ties are pulled laterally from under the track. A new tie is inserted, and tie plates, spikes and anchors are installed to couple the rail to the tie. The ballast is re-arranged, if necessary, by tamping and vibratory stabilization, often accompanied by realignment and elevational adjustments to the track.

Railway ties are usually replaced using a multi-car apparatus that replaces ties on a section of track as it travels over that section. Specialized rail cars have tie removal machinery and means to remove, unload and install ties. Advantageously, worn ties that are removed are exchanged with newly installed ties, rather then being left along the track for later collection. In addition to storage space for the ties, the apparatus can include various transport conveyors, tie removal devices and mobile cranes for manipulating the ties.

An example of a rail carried system is disclosed in U.S. Pat. No. 5,467,717 -Theurer, wherein a multi-car work train has tie storage cars, tie pulling and insertion devices and movable cranes. Two mobile boom cranes that engage individual ties are longitudinally movable on flanged wheels along guide rail sections atop the front and rear cars, and over gondola a cars bridged by a guide rail track. A load-straddling gantry crane is movable on guide rail sections that bridge between the tie storage cars for moving groups of stacked ties. The cranes are used for manipulating old and new ties in conjunction with tie pullers and inserters, conveyors and storage areas for the old and new ties.

The front and rear cars carry the cranes for assisting in the removal of old ties and the placement of new ties. For example, the front car crane can reach down to the track area for grasping ties left by the tie puller. The gantry crane is used for transporting old ties to a storage car and new ties to the rear of the train where the rear car crane lays the ties on the tracks for insertion underneath the rails.

Although Theurer discloses an integrated tie replacement system, it would be advantageous to improve the efficiency of storage and transportation of the ties. Theurtr utilizes open flat cars with upright supports which abut longitudinally against stacks of laterally extending ties. This is a compact arrangement for new ties, but old ties often are broken or splintered and do not stack in an organized manner. Old ties need a container or the like that is sufficiently closed to contain splintered ties and shards, but which nevertheless is readily accessible and can be fully loaded.

The span of the Theurer gantry crane that is movable atop flatbed cars for transporting ties limits the number of ties that can be engaged. A gantry crane also requires a high vertical clearance that can pose a problem during tie exchanging operations in vertically confined spaces such as tunnels.

It would be advantageous to provide a tie exchanging train and a method of exchanging ties which optimizes the efficiency of storage and transportation of rail ties along the length of the train.

SUMMARY OF THE INVENTION

It is an object of the invention to provide a railway maintenance vehicle which travels along a track and efficiently transports, stores and exchanges railroad ties.

It is a further object to provide a vehicle which integrates tie removal and storage of old ties as much as possible with the distribution and installation of new ties.

It is another object to adapt the structure and operation of tie grasping and transport vehicles movable on guide rails atop gondola cars, to efficiently operate for storage of removed ties and unloading of new ties at different points proceeding from one point along a multi-car maintenance train to another, including devices to reach into the gondola cars from above and to temporarily hold ties being passed from one area to another.

These and other objects are accomplished according to the invention by a tie transfer rail vehicle which exchanges old ties for new ties and comprises a plurality of cars, preferably including gondola type cars with closed sidewalls and open tops for storage of ties. The tie exchanging operation commences with the old or existing ties being drawn out from beneath the rails and placed on the rails for pick up by an old tie pick-up device which can place the ties on a conveyor leading to an accumulating location. The old tie pick-up car alternatively can have a collection cage attached to its front at track level to pick up old ties lying on the rails. The old tie pick-up car has a conveyor which transports the tie to a temporary old tie collection area which is located on the old tie collection car.

A plurality of storage cars hold new ties for distribution and collected old ties, space for storage of old ties being made available as new ties are unloaded and distributed. The storage cars can be coupled between a tie distribution car at the rear of the apparatus and the old tie collection car at the front. Thus it is necessary for tie transport vehicles to shuttle back and forth between an old tie loading point, a new tie unloading point (the positions of which vary as work progresses) and the front and rear of the apparatus. The storage cars have guide rails along their tops, including telescoping hinged sections which bridge between successive cars, to allow at least one tie transport vehicle and a tie pick up vehicle to travel along the length of the storage cars. Old ties are collected from the temporary tie collection area and transferred to a first storage car by the transport vehicle. A tie collection basket is movably placed in one of the gondola cars and forms a temporary storage location, where ties left by the tie loader vehicle are placed for pickup and transport in a group by one of the tie transport vehicles. The loader vehicle moves the tie collection basket into position and loads ties into the tie collection basket. The ties are then picked up by the transport vehicle and moved and unloaded onto the tie distribution car where they are distributed along the rails for replacement there under.

Other objects, advantages and features of the invention will become apparent from the following detailed description of the invention when considered in conjunction with the accompanying drawings.

BRIEF DESCRIPTION OF THE DRAWINGS

There are shown in the drawings embodiments of the invention as presently preferred. It should be understood, however, that the invention is not limited to precise arrangements and instrumentalities shown as examples.

DETAILED DESCRIPTION OF THE PREFERRED EMBODIMENTS

Figure 1:
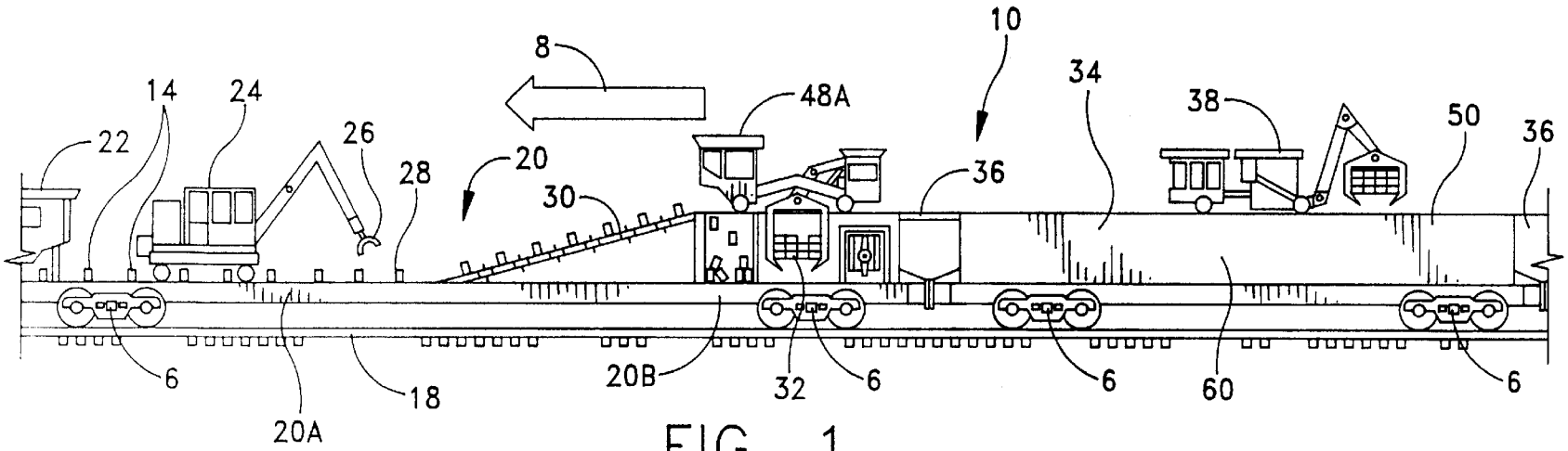
FIG. 1 is a side view of a first embodiment of the tie exchanging vehicle.
Figure 1A:
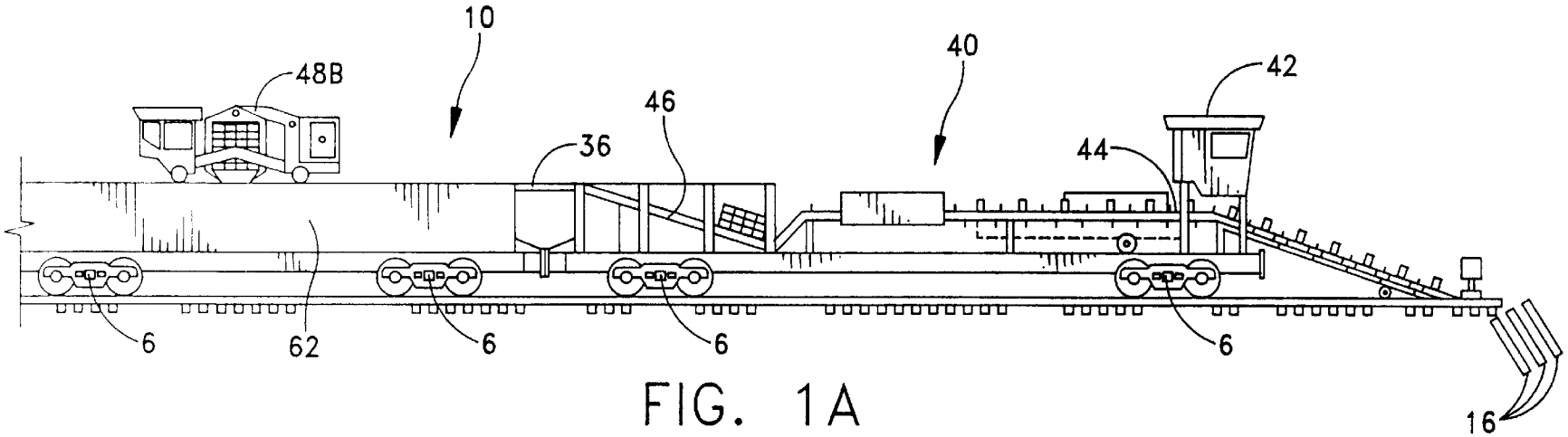
FIG. 1A is a side view of a first embodiment of the tie exchanging vehicle.

In the drawings, the same reference numbers are used throughout to identify corresponding elements. FIGS. 1 and 1A show a tie exchanging vehicle 10 for the removal of worn ties 14 and the distribution of new ties 16. The vehicle 10 comprises old tie pick-up car 20, a plurality of storage or gondola cars 60 and 62, and new tie distribution car 40. Tie pick-up car 20, storage cars 60 and 62, and new tie distribution car 40 as shown are supported on standard rail undercarriages 6. In the alternative, one or more of cars 20, 40, 60 and 62 could be road vehicles which are adapted for rail travel by railway guide wheel devices, such as the type disclosed in U.S. Pat. No. 5,186,109 and 5,154,124.

Storage cars 60 and 62 store old ties 14 after they are removed from the rails 18 and store new ties 16 for distribution along the rails 18. All the cars can be loaded initially with new ties, leaving only a small space for initial collection of worn ties. As new ties are unloaded, their space is available for old ties to be stored. It can be assumed in FIGS. 1 and 1A that cars 60 are currently in use for storage of old ties and cars 62 contain new ties to be distributed. The new tie distribution car 40 is located at the rear of the tie exchange vehicle 10, attached to cars 60 and 62. In the embodiment shown, distribution car 40 accepts new ties 16 in a group from cartop transport 48B and a conveyor spaces and carries the ties rearward to eject the new ties onto the track bed, where they are placed underneath the rails 18 by a subsequent tie replacement machine (not shown). It would also be possible to place a tie replacement apparatus directly at the rear of vehicle 10.

New tie distribution car 40 and storage cars 60 and 62 are likewise coupled to old tie pick-up car 20 at the front of vehicle 10. Old tie pick-up car 20 is shown in greater detail in FIG. 2. Tie pick-up car 20 can be self propelled to provide the motive force for moving vehicle 10, or the vehicle can be drawn by a locomotive. Old tie pick up car 20 moves along the rails in the direction indicated by arrow 8, in which the old ties 14 and new ties 16 are to be exchanged. Old tie pick-up car 20 includes an operator's cab 22 where the operator controls the various devices located on old tie pick-up car 20, including power to move vehicle 10.

Figure 2:
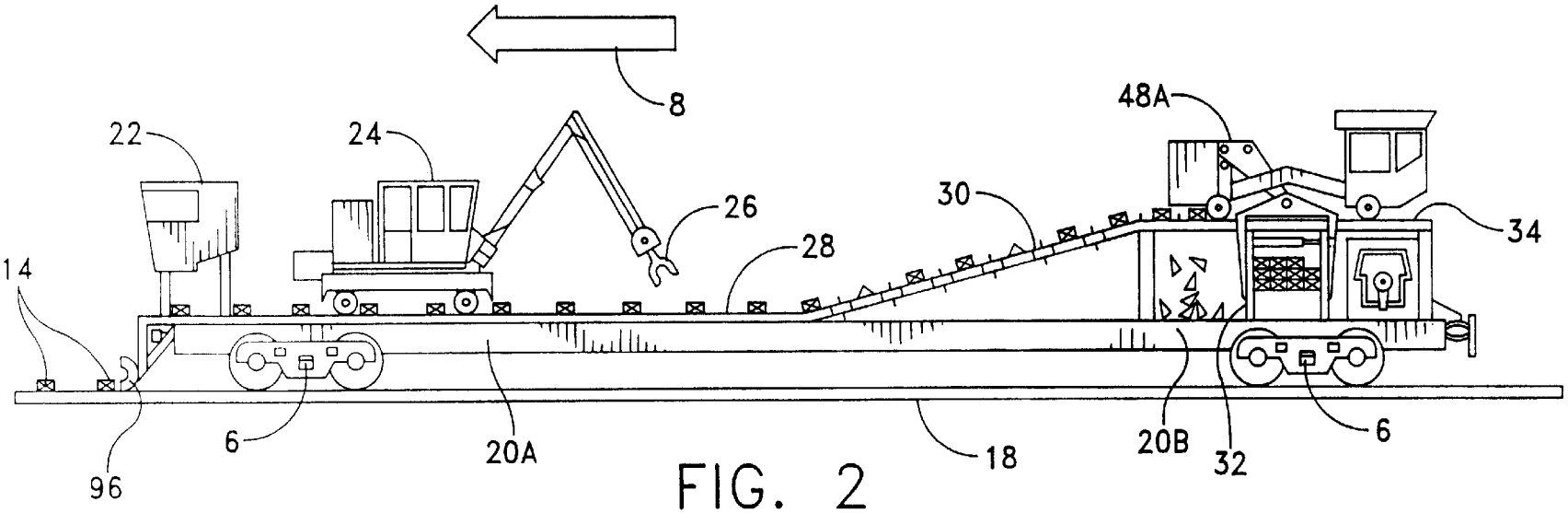
FIG. 2 is a side view of the old tie pick-up car of the tie exchanging vehicle.

In the embodiment shown in FIGS. 1–2, a tie collection cage 96 is mounted to the front of old tie pick-up car 20. The tie collection cage 96 scoops up the old ties 14, which are left lying on the rails 18 by a preceding tie extraction apparatus (not shown), as the vehicle 10 travels along the rails 18. Conveyor belts 28 and 30 transport collected old ties 14 upwardly and rearwardly from collection cage 96 to drop into a temporary receiving bin 32, where the old ties are accumulated. Tie collection cage 96 can comprise a tie pickup mechanism of the type shown in U.S. Pat. No. 5,197,389, the contents of which are incorporated. In such a device, a tie clamp engages the old ties 14 which are then elevated to the level of conveyor belt 28.

Tie collection cage 96 can only capture ties 14 readily if left across the tops of rails 18. In order to pick-up ties located on the field sides of rails 18 or otherwise inaccessible to collection cage 96, a tie crane 24 is disposed on old tie pick-up car 20. Ties also often fracture during removal, and tie crane 24 can handle relatively small pieces. For this purpose, tie crane 24 includes a gripping device 26 at the end of a crane arm, which is mounted on a rotatable chassis for accessing an area along the sides of the track. Tie crane 24 is supported on flanged wheels that straddle conveyor belt 28 providing clearance for ties 14 on conveyor 28 to pass beneath crane 24. Crane 24 also can be moved longitudinally along the front section 20A of tie pick-up car 20. When a tie 14 or piece of a tie is picked up from the side of the track, crane 24 can place it on conveyor 28.

Elevated rear section 20B of pickup car 20 includes a temporary tie storage compartment 32 in which ties from conveyor 30 are accumulated in a generally parallel group. A set of guide rails 34 are provided along the top of rear section 20B on either side of compartment 32 and extend continuously rearward along the tops of the gondola cars. Tie transport and loading vehicles (discussed in detail below) travel along guide rails 34, to remove accumulated ties from compartment 32 and transport them to an old tie storage location, for example in one of cars 60. Guide rails 34 start at rear section 20B and extend along the top of storage cars 60 and 62 to an elevated front section 40A of new tie distribution car 40 at the far end of vehicle 10.

As shown in FIGS. 1 and 1A, cars 60 for storage of old ties are located immediately behind old tie pick-up car 20. Storage cars 62 holding new ties are located nearer to tie distribution car 40. As maintenance vehicle 10 moves along, old and new ties are moved rearwardly by tie transport cars that shuttle back and forth between the pickup or distribution cars 20, 40, and respective locations where old ties are stored or new ties unloaded. Generally, old ties are stored first in the front tie storage car and new ties are unloaded first from the front-most part of the new tie supply. The line between old and new ties moves backwardly over time.

The tie storage cars 60, 62 are preferably gondola type rail cars, namely defining open top rectangular storage containers 61 in which the ties are laterally stacked. Alternatively, storage cars 60 and 62 can comprise flat cars with open-top rectangular storage containers 61 mounted similarly and provided with a continuous guide rail over which the tie transports can move. Open top storage cars allow efficient access to their interiors, but require an apparatus that can reach down into the interior to pick up ties.

Figure 6:
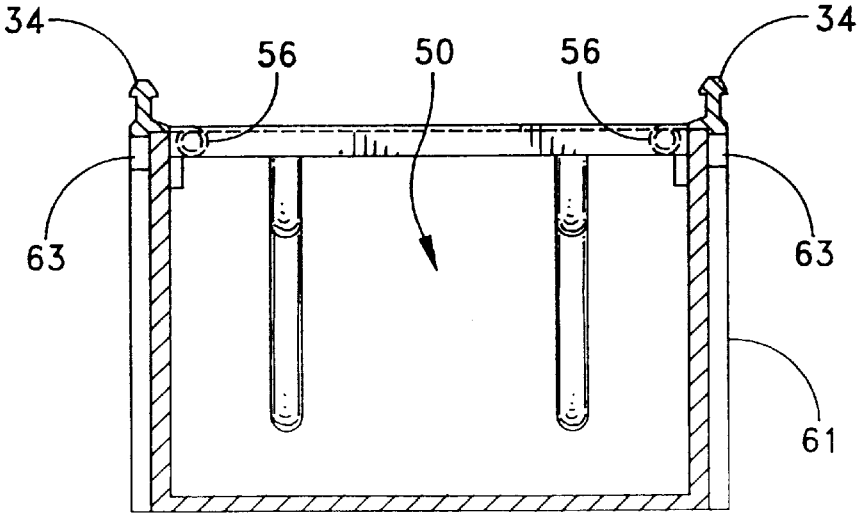
FIG. 6 is a cross-section view taken along line 6—6 of FIG. 9.
Figure 9:
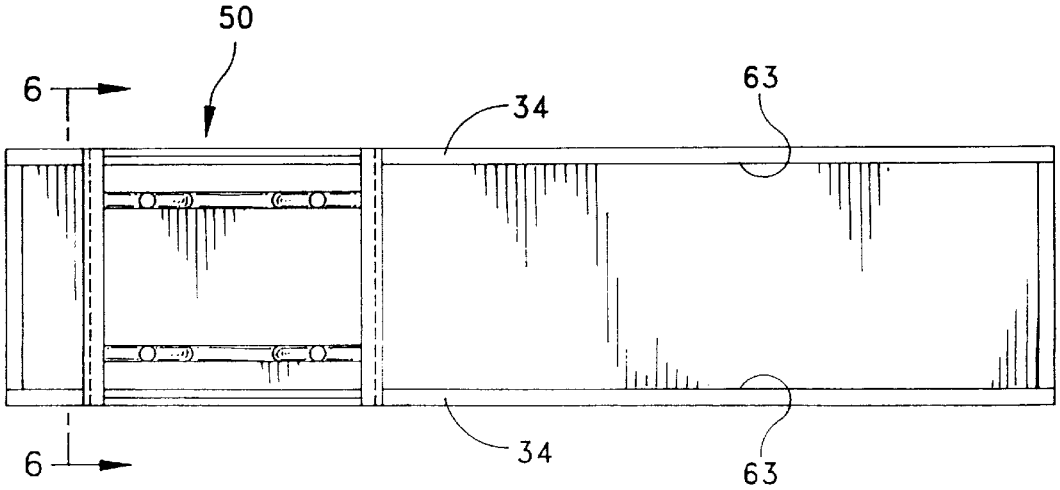
FIG. 9 is a plan view showing the storage basket placed within a storage car.
Figure 10:
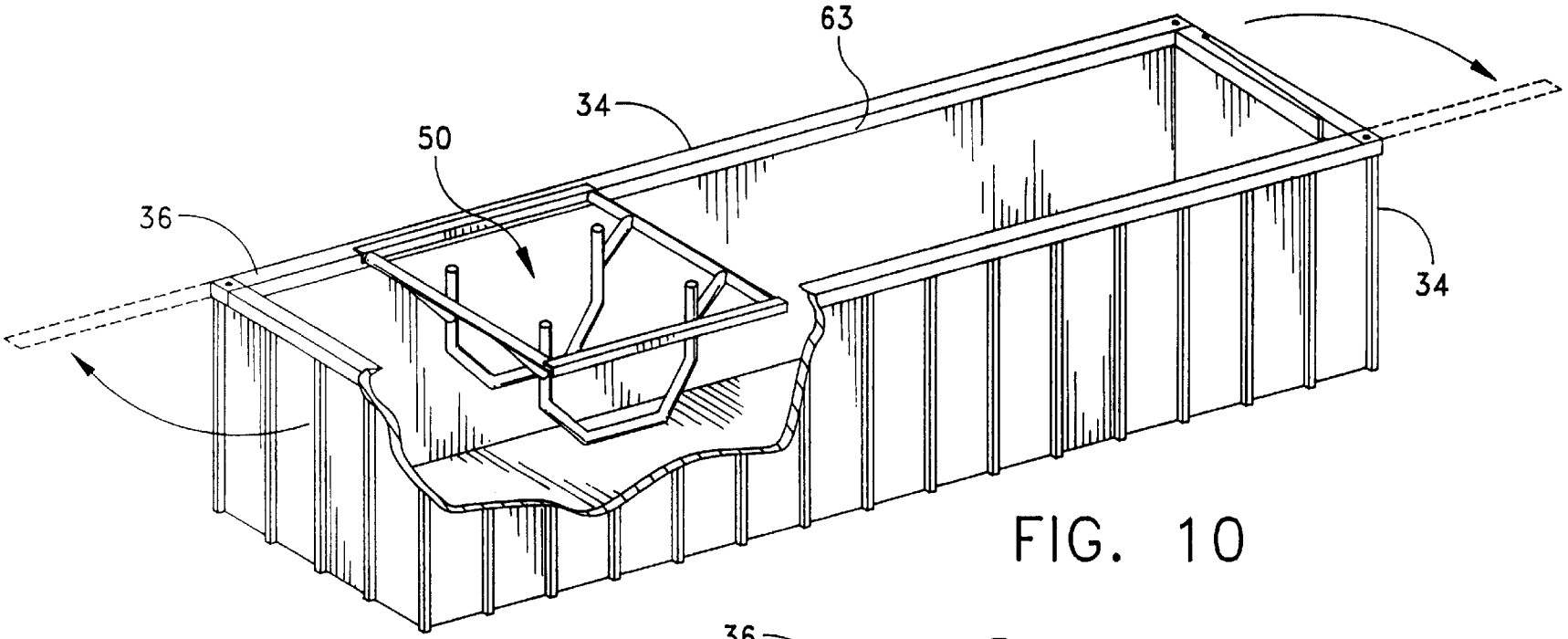
FIG. 10 is a side elevational cut away view of a storage container having guide rails mounted thereto.
Figure 11:
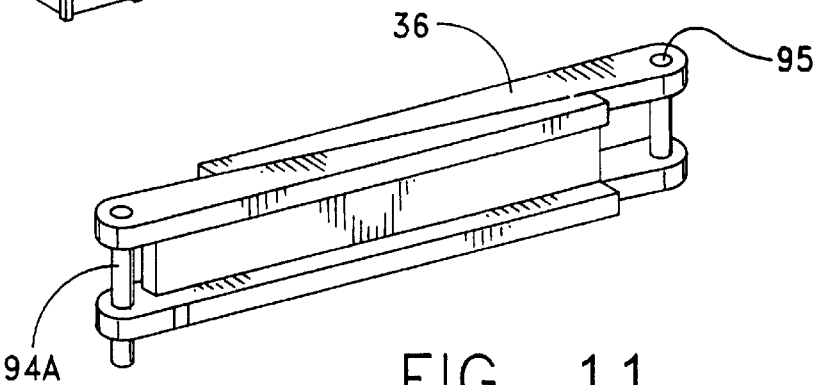
FIG. 11 is a side elevational view of the hinged intermediate guide rail piece.

FIGS. 6, 9 and 10 show certain details of a rectangular storage container 61. A flange 63 is fixed to each top outer edge of the walls of container 61 to support guide rails 34. Guide rails 34 may be welded or otherwise mounted to the flange 63. In this manner, guide rails 34 are placed along the outside of storage cars 60 and 62. To span the gaps between adjacent cars 20, 60, 62 or 40, intermediate guide rail lengths 36, shown in detail in FIG. 11, are placed between the guide rails 34 of adjacent cars. Each intermediate guide rail 36 is hinged to the end of one guide rail 34 via slot 94 and pin 94A, and to a corresponding guide rail of the next car via pin 95. When it is desired to separate adjacent cars, pin 95 is removed, and intermediate piece 36 is pivoted inwardly about pin 94A into a closed position as shown in phantom in FIG. 10. To accommodate relative displacement between the ends of the cars when vehicle 10 passes around turns, each intermediate piece 36 comprises two telescoping parts, for example tapered sections having interlocking flanges or a pin and slot arrangement for telescoping.

As discussed above, as work proceeds worn ties are stored at points progressively further to the rear and new ties are unloaded at points progressively further to the rear. As such, the tie transports that move back and forth on rails 34 have an equal traveling distance when vehicle 10 is at half its capacity, but may have very unequal travelling distances when the storage cars are nearly all occupied by new or old ties, respectively. Efficiency requires that the tie transports move an equal number of ties per unit of time. According to an inventive aspect, one or more moveable tie collection baskets 50 are provided and can be placed at any longitudinal point in cars 60 and 62 to provide a relocatable collection and delivery point.

Figure 5:
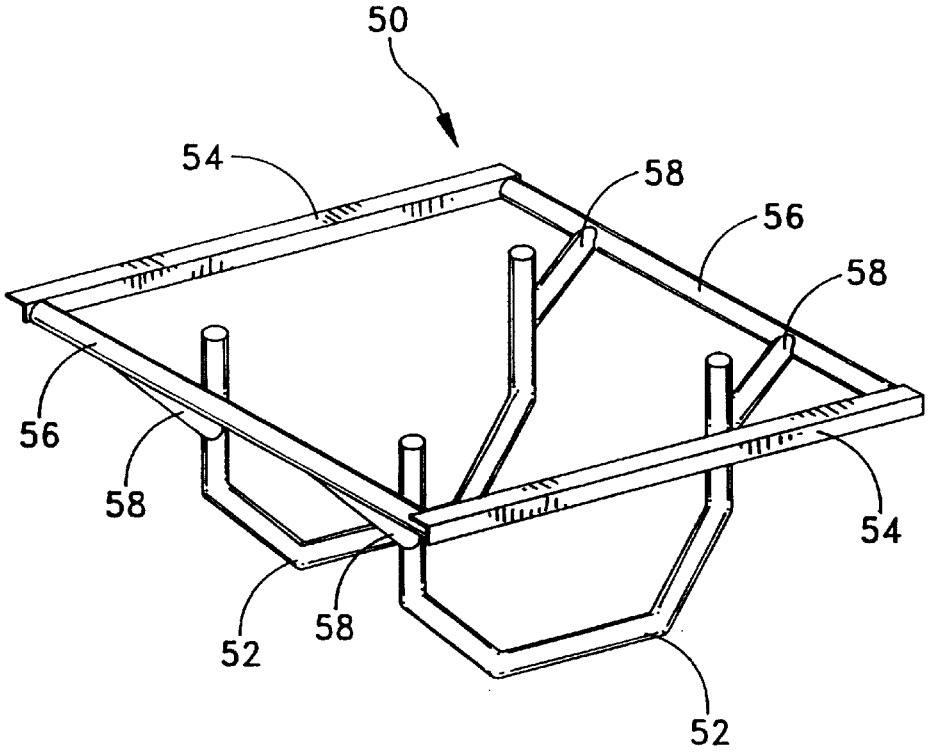
FIG. 5 is a side elevational view of the tie collection basket.

As shown in FIG. 5, basket 50 comprises two U-shaped cross members 52, connected to two tubular longitudinal members 56 by vertical support members 58 and lateral supports 54, connected to opposite ends of tubular members 56. As shown in FIGS. 6, 9 and 10, tie collection basket 50 is supported in cars 60 and 62 by lateral supports 54. The lateral supports rest on the inner portion of flange 63 so that the tops of the lateral support members 54 reside below the top profile of guide rails 34. Thus, basket 50 does not interfere with the tie transport vehicles travelling along rails 34. However, basket 50 provides an excellent receptacle in which ties can be either accumulated in small numbers to be transported as a group, or deposited in a group to be extracted individually or in small groups. This facilitates loading or unloading and provides a means by which an intermediate tie transport and pickup vehicle, for example boom transport 38 in FIGS. 1 and 1A, can assist by accepting a bundle of ties from a tie bundle transport 48A, or delivering a quantity of ties to a tie bundle transport 48B, at a position closer to the bundle transport than the source or destination of the ties in cars 60, 62.

Old ties 14 and new ties 16 are transported along the length of vehicle 10 by at least one, and preferably a plurality of car top tie transporter vehicles 48. Preferably, a car top tie loader vehicle 38 arranges and efficiently packs the used ties within the storage cars 60 and 62 and/or moves basket 50 along cars 60 and 62 where new ties Are loaded into basket 50. At least one larger car top tie transporter 48 grasps and transports a large number of ties from within basket 50.

Figure 7:
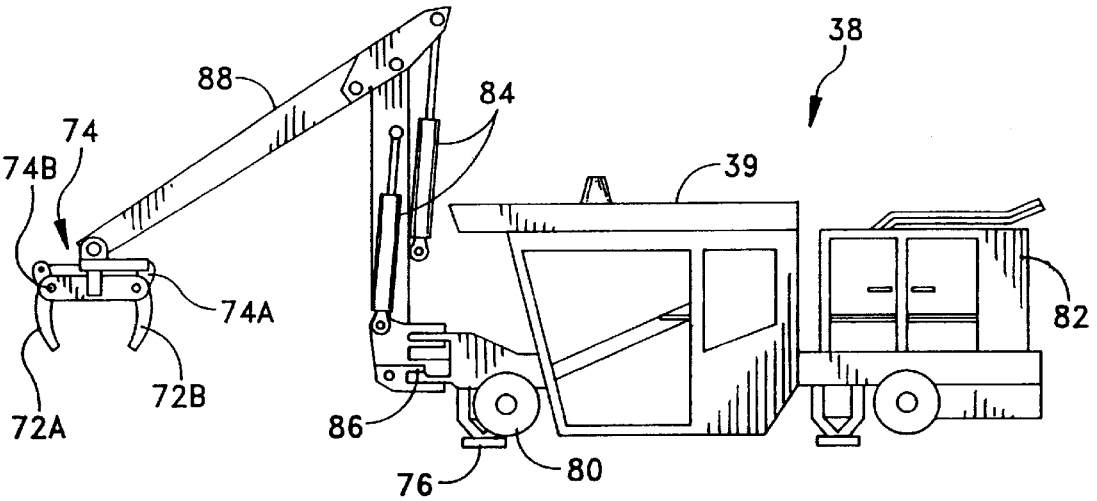
FIG. 7 is a side view of the tie loading vehicle.
Figure 8:
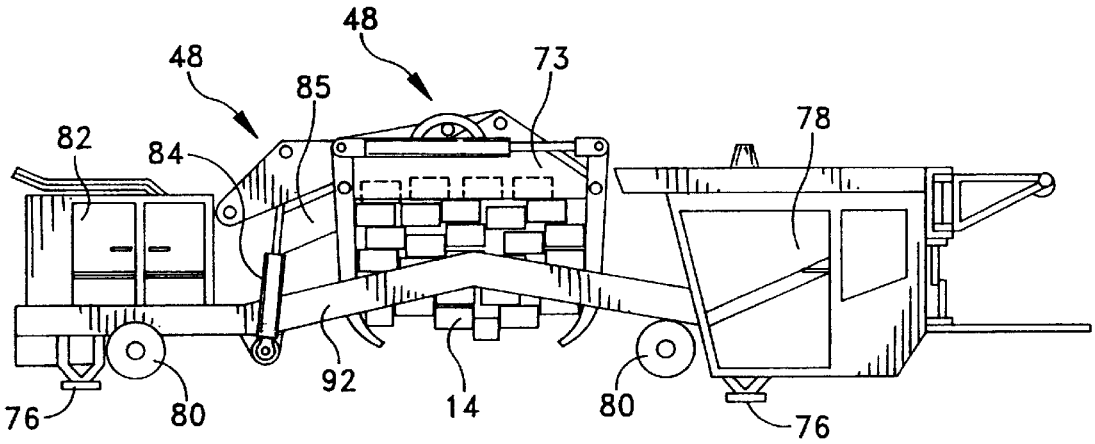
FIG. 8 a side view of the tie transport vehicle.

As shown in FIGS. 7 and 8, loader 38 and transporter 48 both have flanged wheels 80 which allow the loader 38 and transporter 48 to travel along guide rails 34. To keep loader 38 and transporter 48 from de-railing or falling from vehicle 10, anti-derailment rollers 76 oppose the flanges of wheels 80 and grip the outer, lower edge of guide rails 34, for example below a flange thereon.

Tie loading vehicle 38 can perform a wide variety of lifting and arrangement tasks to ensure the efficient storage of new ties 16 and old ties 14 within storage cars 60 and 62. A primary task of loader 38 is to move and load basket 50 with new ties 16. Loader 38 is comprised of a body having a motor housing 82 and an operator's cab 78. A crane boom or arm 88 is connected to the body of loader 38 and moves vertically and horizontally relative to cab 78 by operation of lateral drive 86 and hydraulic drive cylinders 84, respectively. A tie grapple 74 is located at the distal end of crane arm 88. Tie grapple 74 comprises two scissor arms 72A and 72B, pivotally connected to a central arm 70 below the proximal ends of arms 72A and 72B. A hydraulic cylinder 75, is coupled to the proximal end of scissor arms 72A and 72B, to move arms 72A and 72B from an open position to a closed grasping position.

Tie grapple 74 can grip a large number of ties directly from within the cars 60, 62 and load them into basket 50 (about forty in the embodiment shown). In order to lift basket 50, arms 72A and 72B are opened and tie grapple 74 is lowered so that arms 72A and 72B are positioned on opposite longitudinal sides of basket 50. The arms 72A and 72B are closed so that the proximal ends of arms 72A and 72B engage the tubular supports 56 of basket 50 while the distal ends of the arms 72A and 72B engage the bottom of u-shaped cross members 52.

As shown in FIG. 8, tie transport vehicle 48 comprises a motor housing 82 and an operator's cab 78. A main crane arm 90 is connected on a horizontal pivot axis to the motor housing 82 and is moved vertically relative to motor housing 82 by operation of a hydraulic drive cylinder 84. A rocker beam 73 carried on arm 90 carries grapple members 64A, 64B and is adjustable as to tilt by another hydraulic cylinder 85, coupled between motor housing 82 and a point on rocker beam 73 below its pivot connection with arm 90. Crane arm 90 carries its load centrally between housing 82 and cab 78 so that the cantilevered weight of the load on crane arm 90 is evenly carried in a stable manner between cab 78 and motor housing 82 and between wheels 80. Thus a substantial load of ties can be transported dependably without the danger that the tie transport might tip, as could occur with a laterally extendable arm as on tie loader 38. In order to handle this larger capacity, oversized tie grapples 64A, 64B are pivoted on rocker beam 73 and opened or closed by cylinder 66, coupled between the distal ends of the grapples above their pivots with beam 73.

Figure 3:
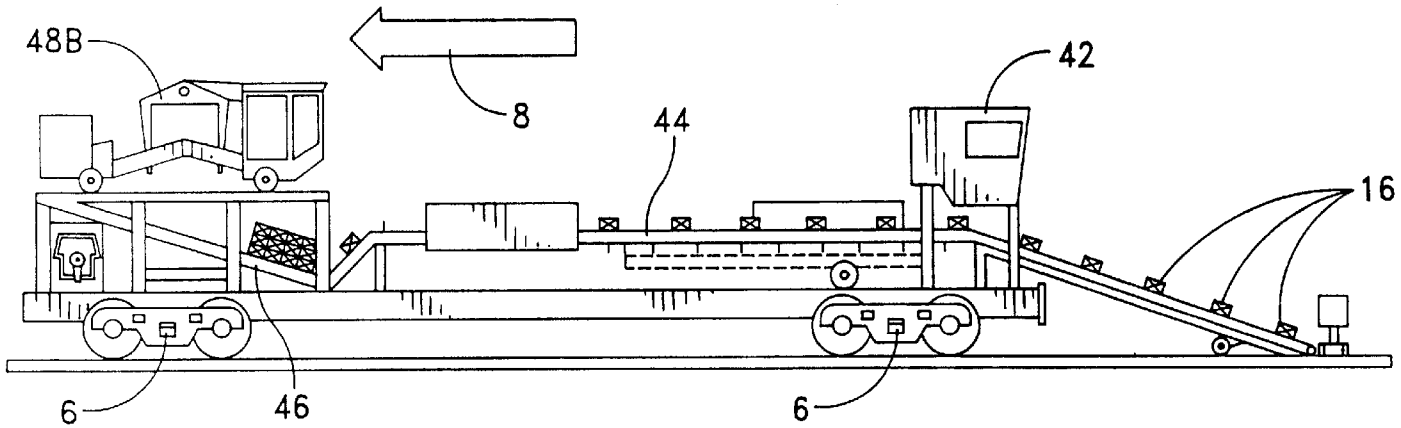
FIG. 3 is a side view of the new tie distribution car of the tie exchanging vehicle.

If necessary, tie transporter 48B can be used to move and place basket 50 in a desired tie storage car 62, such as the car located immediately in front of new tie distribution car 40. However, the primary function of transporter 48B is to unload ties from basket 50 and transport the new ties 16 to the elevated front section 40A of new tie distribution car 40 as shown in greater detail in FIG. 3. A new tie receiving compartment 46 is located within the elevated front section 40A. Transporter 48 unloads new ties 16 into the compartment 46 which is accessed through an opening atop front section 40A between guide rails 34. Compartment 46 slopes so that new ties 16 slide onto conveyor 44 which spaces and transports the new ties 16 onto rails 18.

To summarize, the tie exchanging operation commences with the rail anchors 12 being separated from the old ties 14 that are to be replaced. The ballast can be cleared to more readily grasp the tie ends, or the worn ties 14 can be simply grasped and pulled lengthwise from underneath the rails 18. The removed ties are placed atop or aside rails 18 to be picked up. As shown in FIG. 1, the old tie collection car 20 is located at the front of vehicle 10. The old ties 14 have previously been removed from underneath rails 18 and are awaiting pick-up. Old tie pick-up car 20 pulls vehicle 10 along rails 18 so that cage 96 captures old ties 14. Crane 24 picks up any ties 14 which are fractured or otherwise unable to be captured by cage 96. After the ties 14 are picked up, they are transported by conveyors 28 and 30 to temporary tie storage compartment 32. Tie transport vehicle 48 positions itself over the open compartment 32 and loads old ties 14 and transports them to one of old tie storage cars 60 where the ties 14 are unloaded.

At the same time old ties 14 are being picked-up from the rails 18 and loaded onto old tie storage cars 60, tie loading vehicle 38 and tie transporter 48B are moving new ties 16 from storage cars 62 to the rear. Loader 38 moves basket 50 and loads basket 50 with ties so that transport 48B can unload ties from the basket 50 and transport them to the new tie distribution car 40. After transport 48B unloads ties from basket 50, loader 38 accumulates additional new ties in basket 50 for transport 48B to move rearward. Transport vehicle 48 unloads ties 16 and places them within new tie receiving compartment 46. The ties are then transported by conveyor 44 onto rails 18. When the respective distances are such that new ties are available at a short distance from distribution car 40 but worn ties must be stored at a longer distance from collection car 20, one or more baskets 50 can likewise be used in the operation of loading worn ties.

Figure 4:
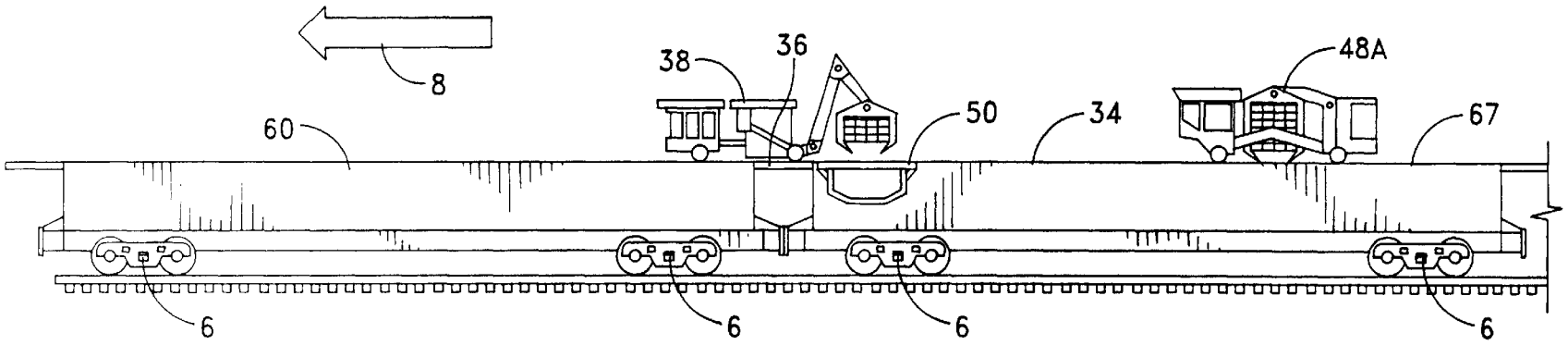
FIG. 4 is a side view of a second embodiment of the tie exchanging vehicle.
Figure 4A:
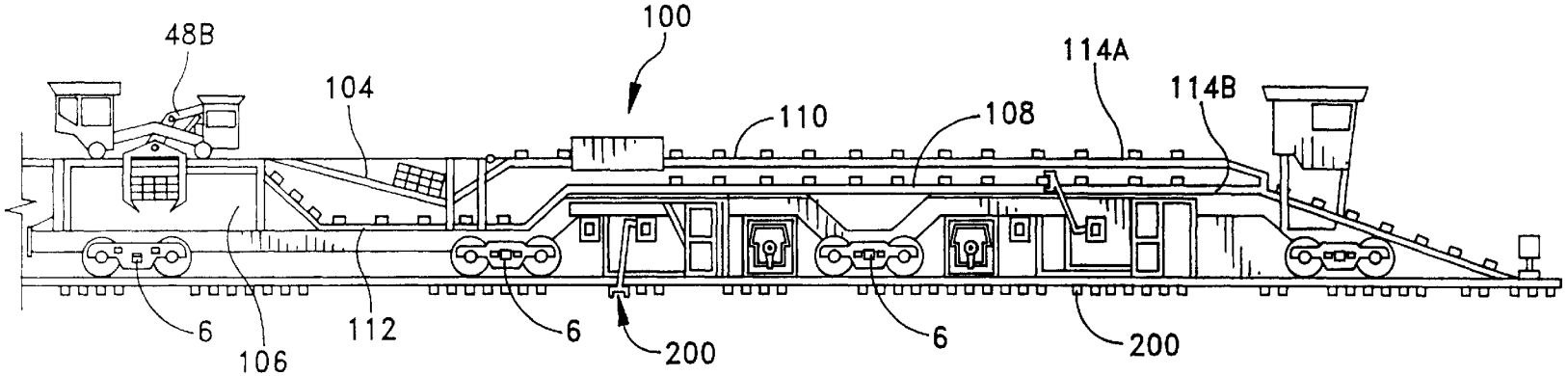
FIG. 4A is a side view of a second embodiment of the tie exchanging vehicle.

A preceding separate vehicle can be used for extracting old ties 14 from beneath rails 18, or alternatively this function can be provided as an element of vehicle 10. FIGS. 4 and 4A show an alternative embodiment in which tie removal, tie collection and tie distribution functions are joined in a combined car 100. In this embodiment, the combined car 100 is located at the rear of vehicle 10 and is self propelled for movement along the rails in the direction indicated by arrow 8, for exchange of old ties 14 and new ties 16 as the vehicle progresses over the track. One or more storage cars 60 for old ties is located at the front of the vehicle and one or more storage cars 62 for new ties is located behind cars 60.

The combined car 100 has a front section 116 and a rear section comprising an upwardly recessed frame 114 having open sides and first and second levels 114A and 114B. Adjacent one another in rear section 116 are a temporary tie storage area 106 and a new tie receiving compartment 104. Transporter 48 unloads and loads ties to and from compartments 104 and 106, through openings between guide rails 34 at the top of compartments 104 and 106.

At least one and preferably two tie removal and loading devices 200 are mounted on the underside of car 100. Tie removal and loading devices 200 can be of the type disclosed in U.S. Pat. No. 4,418,625 entitled Bi-directionally Operative Tie Exchanging Apparatus, the disclosure of which is hereby incorporated.

Figure 13:
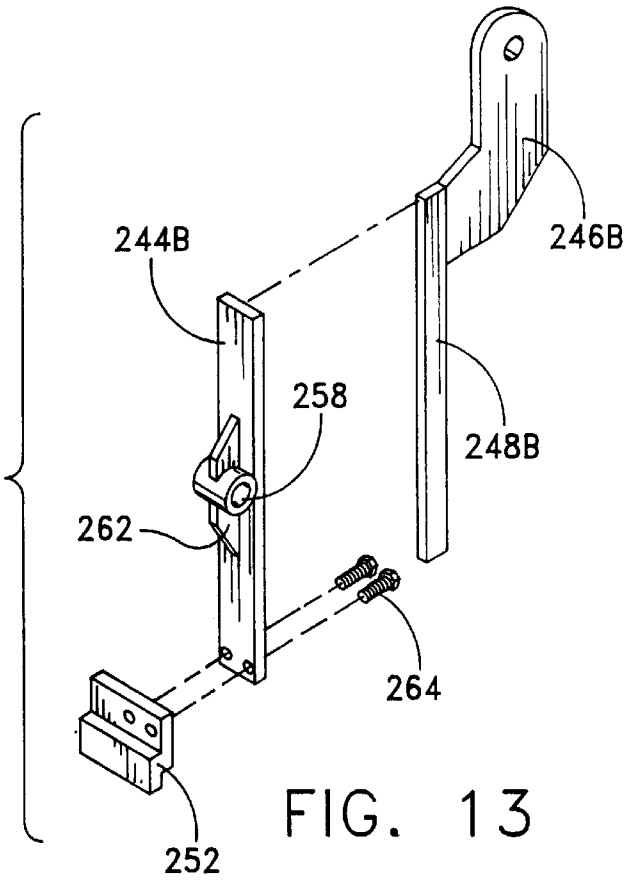
FIG. 13 is an exploded perspective view of one of the clamping arms of the clamping assembly shown in FIG. 12.
Figure 12:
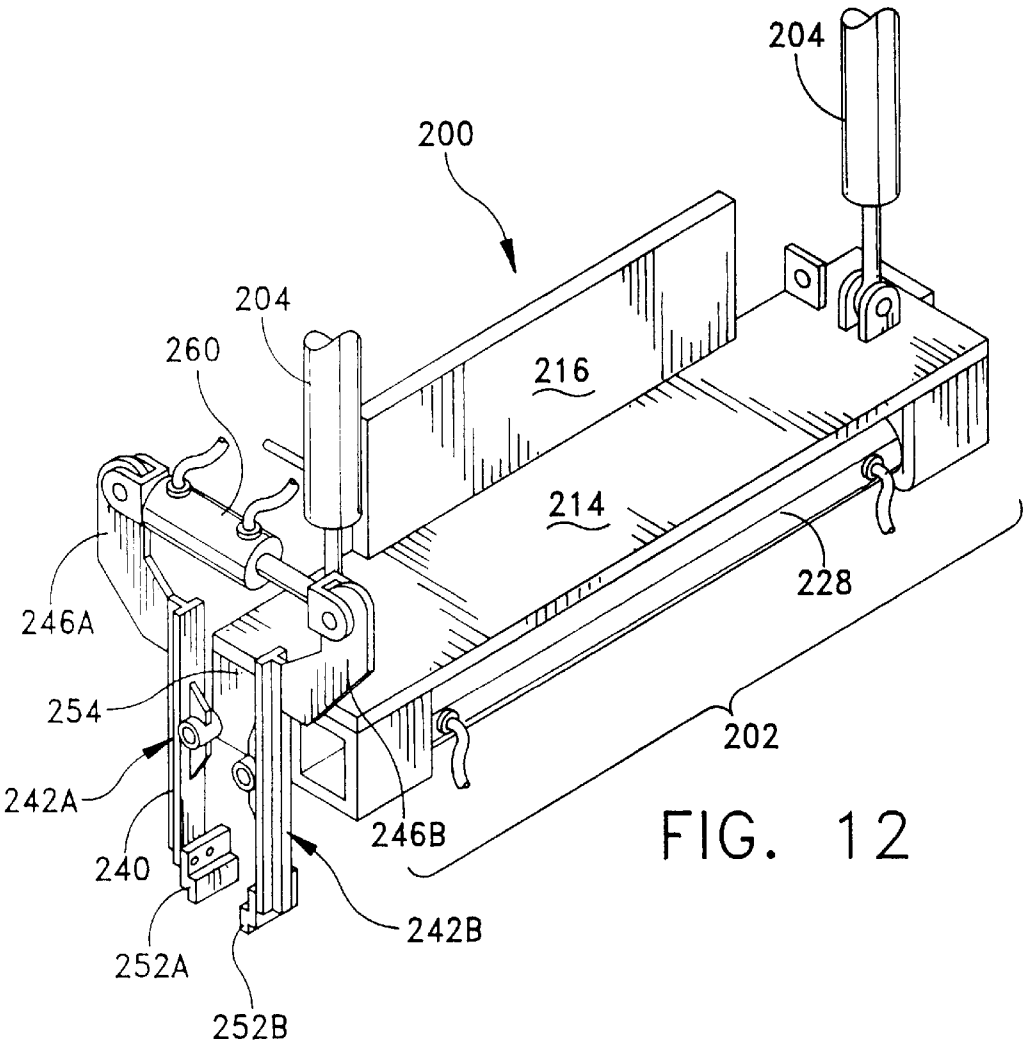
FIG. 12 is a perspective view of the a tie removal apparatus having tie clamping assemblies at the end of a telescoping beam assembly.
Figure 14:
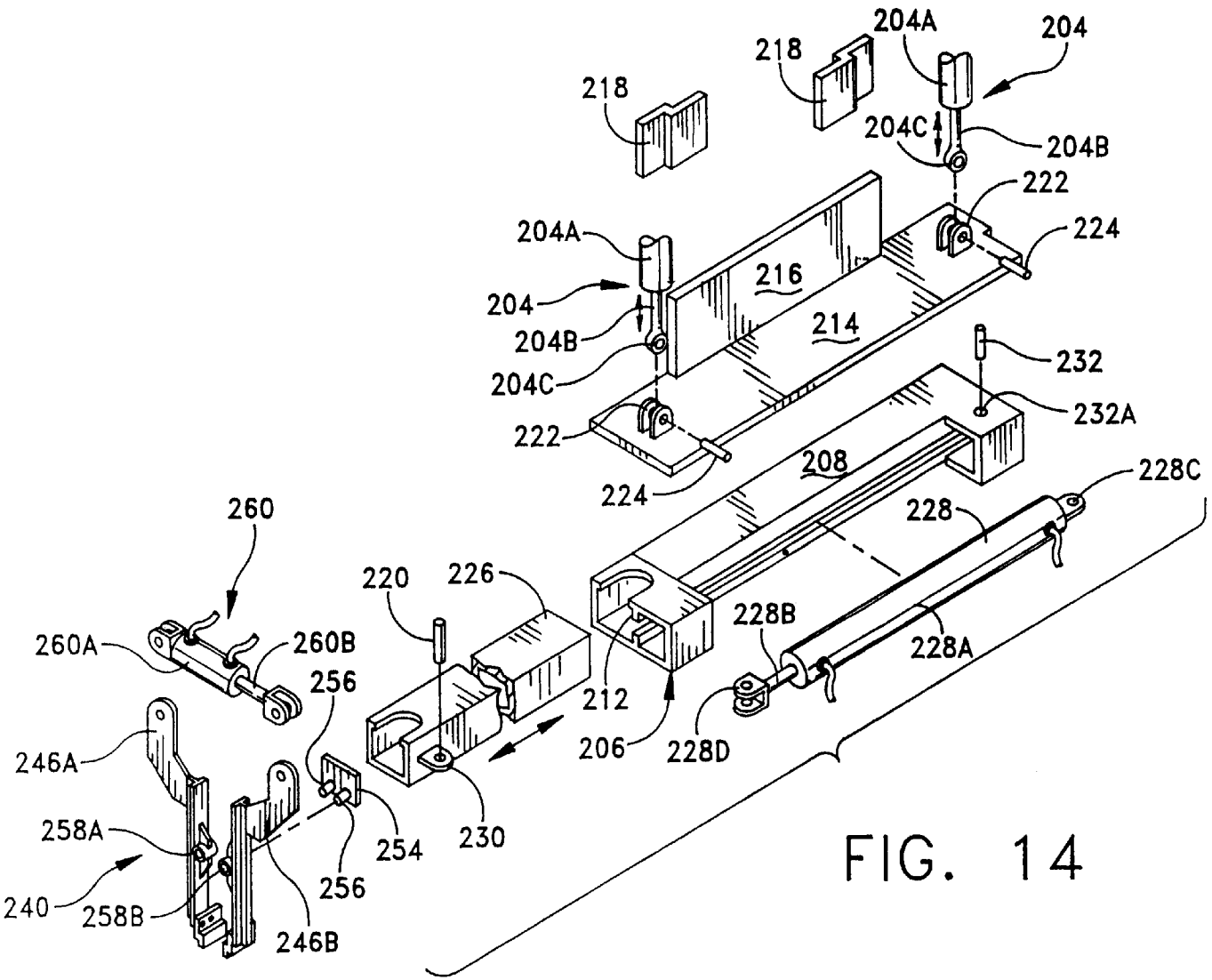
FIG. 14 is an exploded perspective view of the tie removal apparatus shown in FIG. 12.

A first embodiment of a tie extraction and loading device in accordance with the invention is shown in an assembled perspective view in FIG. 12 and an exploded perspective in FIGS. 13 and 14. Device 200 includes a tie clamping assembly 240 at the end of a telescoping beam assembly 202. The tie extraction and loading device 200 is mounted on the underside of the carriage or chassis of combined car 100 by vertically aligned hydraulic cylinders 204 whereby it can be raised or lowered relative to the rail bed by appropriate control of cylinders 204. Device 200 is positioned over a selected tie 14 as car 100 moves along rails 18. The exchanger mechanism is lowered and tie clamping assembly 240 is closed to grasp the tie at an end protruding from the rails. The beam assembly 202 is then extended laterally to pull the tie 14 laterally outwardly from the rail bed.

An exemplary clamping assembly 240 is shown in FIGS. 12, 13 and 14. Clamp assembly 240 includes opposed clamping arms 242A and 242B, fabricated as structural steel weldments. As shown in FIG. 13, clamping arm 242B includes a clamping bar 244B, a reinforcing spine 248B that is welded to the back face of the clamping bar 244B, an outwardly and upwardly extending connecting lug 246B welded to the upper portion of the reinforcing spine 248B, an aperture lug 262 welded to the front face of the clamping bar 244B, and a detachable clamping plate 252 secured to the lower end of the clamping bar 244B by threaded fasteners 264 extending through suitable clearance bores in the lower end of the clamping bar 244B into threaded bores in clamping plate 252.

The clamping arms 242A and 242B are mounted symmetrically relative to vertical on a base plate 254 with hinge pins 256 passing through bores 258A and 258B in aperture lugs 262A and 262B. A bi-directionally operative hydraulic cylinder 122 with a cylinder 124 and ram 126 is connected between the lugs by clevis-and-pin connections with the two clamping arms 242A, 242B. Cylinder 260 operates as shown in solid/broken lines in FIG. 13 to pivot clamping arms 242A and 242B towards or away from one another to grip or release tie 14 between their respective clamping plates 252A and 252B.

The beam assembly 202, as shown in FIGS. 12 and 14, includes first and second cradles 206 for beam 226 and cylinder 228, in the form of hollow rectangular box weldments at the ends of a hollow box-shaped support tube 208. Each cradle 206 includes beam guide plates 212. Cradles 206 and support tube 208 are connected, for example by welding, to the underside of a horizontal support plate 214 with a guide plate 216 secured thereto, extending vertically and parallel to the axis of support plate 214. Guide plate 216 interacts with two support struts 218 that are secured to rail car 100 and slidably guide vertical displacement of beam assembly 202 by restraining guide plate 216. However, side-to-side clearance is provided between the edges of guide plate 216 and support struts 218 to permit some adjustment of the attitude or angular alignment of beam assembly 202 by appropriate differential control of the two spaced hydraulic cylinders 204, which adjust the elevation and attitude of the device. Cylinders 204 each have a cylinder 204A and a downwardly extending ram 204B pivotally coupled to vehicle 100 and support plate 214, the latter by a lug 204C that connects to a pair of spaced aperture tabs 222 via a pin 224.

Cradles 206, support tube 208 and support plate 214 define a frame for supporting an extendible beam 226. Beam 226 comprises an elongated hollow box member slidable in tube 208, carrying tie clamp 240. Beam 226 extends through one of the cradles 206 into support tube 208. Load bearing bushings and shims comprising pads or plates fabricated from a suitable bearing material such as brass, bronze, or the like (not shown) can be placed between the various moving parts to provide an accurate and durable sliding engagement.

The main push/pull actuator 228, such as a hydraulic cylinder, extends and retracts beam 226, and has a cylinder 228A coupled to the cradle at the inboard end of box 208 by a pin 232 through aperture 232A and cylinder lug 228C. The ram is likewise coupled to beam 226 adjacent to its outboard end via a pin 220 through lug 230 and ram clevis 228D.

The clamping assembly of a tie removal device of this kind normally is fixed at the remote end of a laterally extending beam configured only for substantially lateral motion to effect extraction of ties. As a result the ties can only be pulled from under the rails and cast laterally outward to the field side of the rails, where provision must be made to recover the ties. According to a further aspect of the invention as shown in FIGS. 15–25, a tie clamping mechanism is mounted on a telescoping arrangement as above, but further comprises a supplemental displacement mechanism operable while holding an extracted tie horizontally to lift the tie upwardly around an arc while clamped, for inserting the extracted tie horizontally onto a recovery conveyor section disposed over the telescoping tie extraction apparatus. The extraction and recovery of ties thus is simultaneously effected.

According to the embodiment of FIGS. 15–25, the clamping assembly 240 to the outer beam 226 by a parallelogram linkage comprising two parallel inclined bars 234, respectively journalled in a drive unit affixed to the end of the telescoping actuator and a mount housing 236 carrying clamp assembly 240. The parallelogram linkage 234 allows the clamping assembly 240 to be moved laterally outwardly to extract a tie, for example while bars 234 are inclined downwardly, or downwardly and inwardly toward the tie. Upon extraction, the linkage and clamping assembly 240 are rotated vertically outwardly and upwardly around substantially 270° to an elevated position above the telescoping actuator. The actuator is preferably retracted while rotating the tie upwardly, following the progression shown in perspective in FIGS. 16–20 and in elevation in FIGS. 21–25.

Figure 15A:
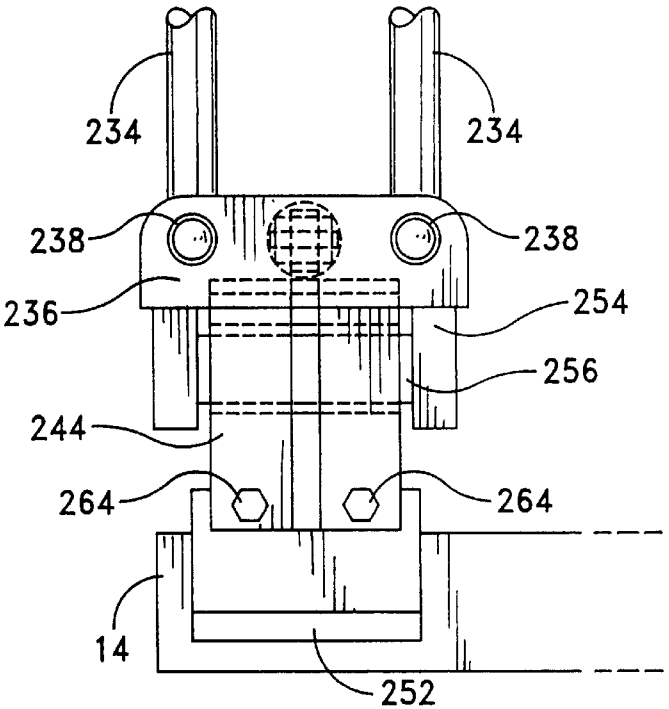
FIG. 15A is a side view of the tie clamp assembly having the mount housing attached to its upper portion.
Figure 15:
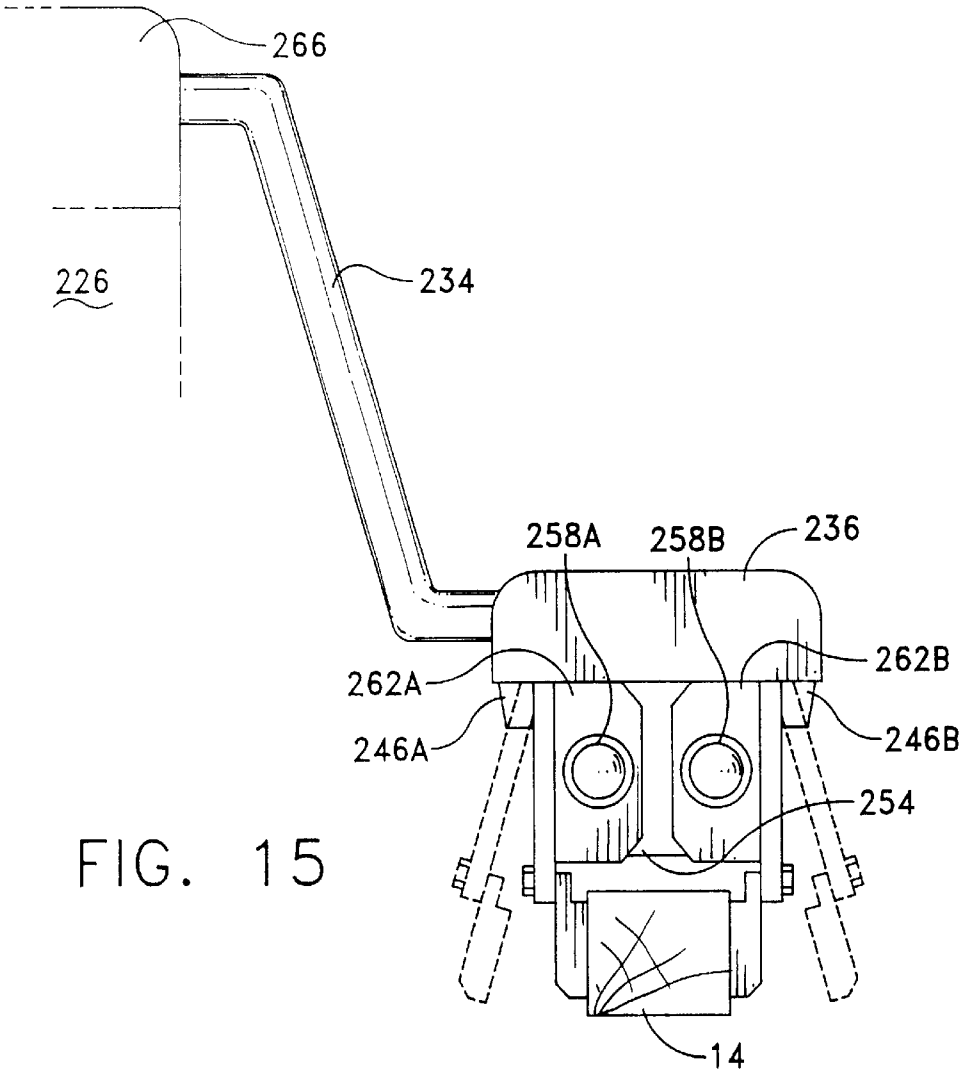
FIG. 15 is an end elevational view of a tie clamp assembly being mounted on a parallelogram support assembly by a mount housing attached to the upper portion of the clamp assembly.
Figure 16:
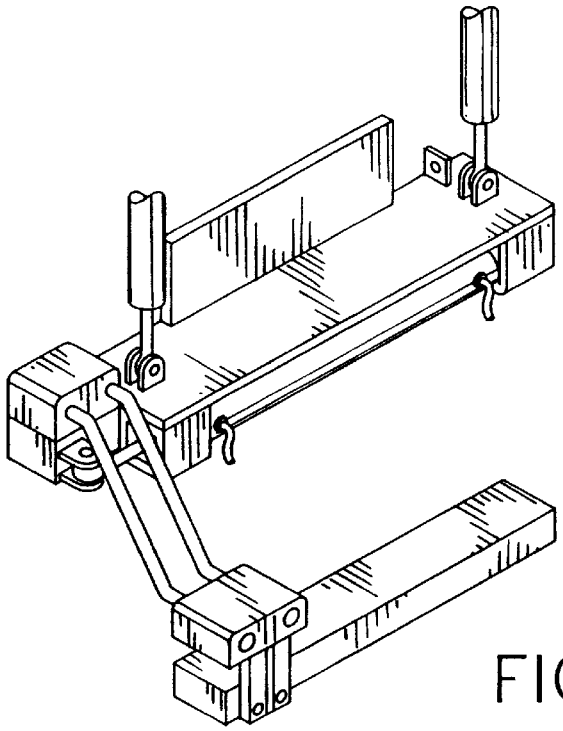
FIG. 16–20 are perspective views illustrating the rotation of the parallelogram support assembly through a tie pick-up and loading cycle.
Figure 17:
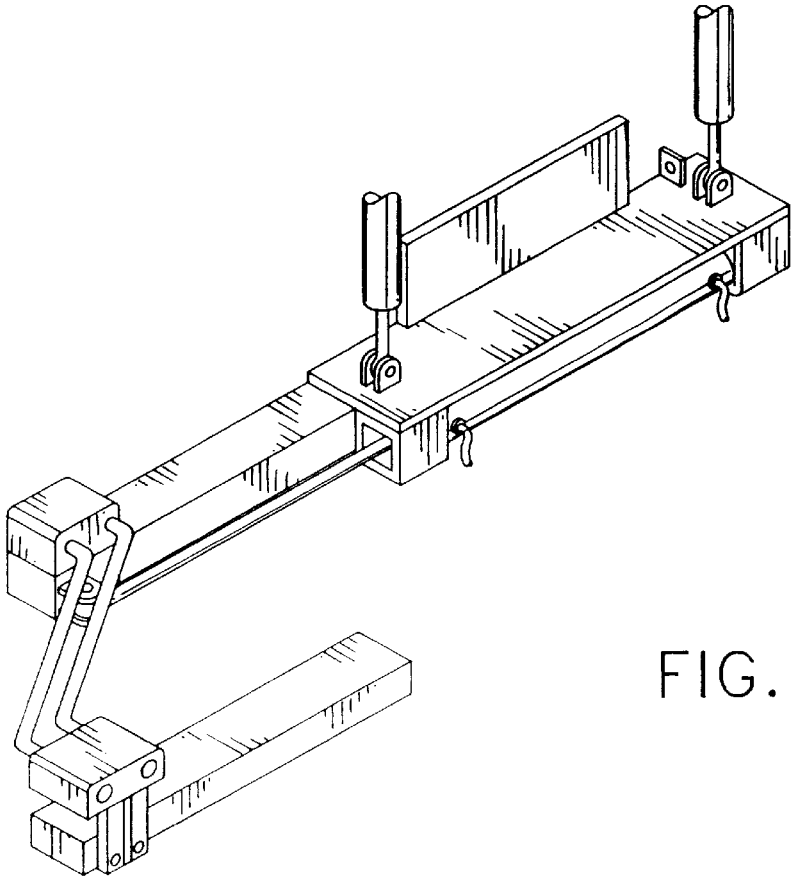
Figure 18:
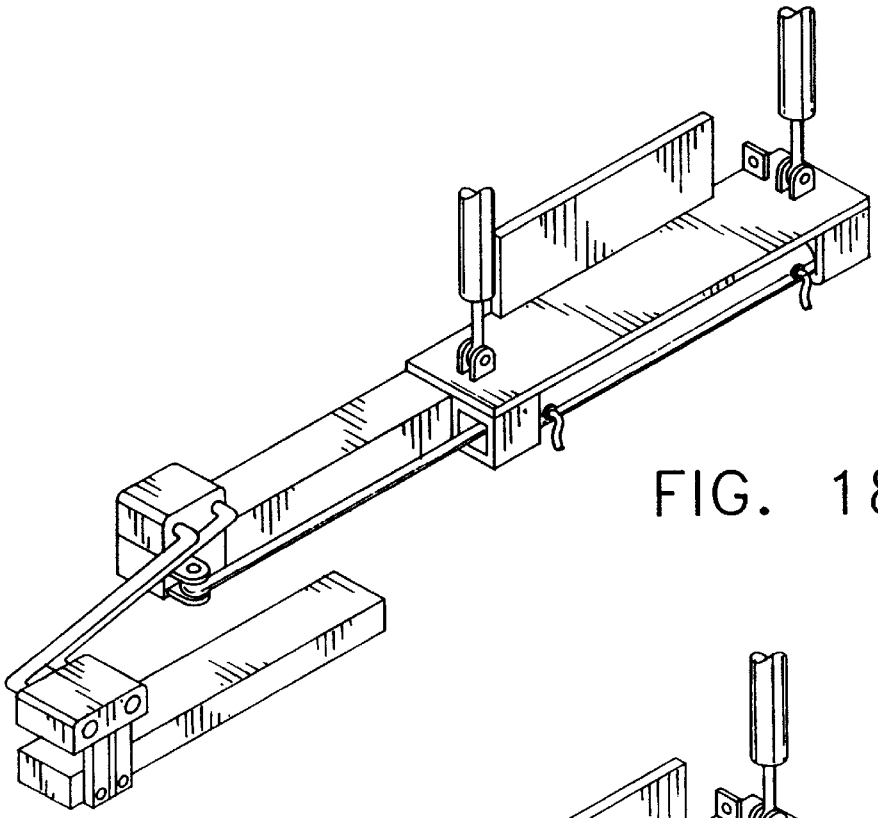
Figure 19:
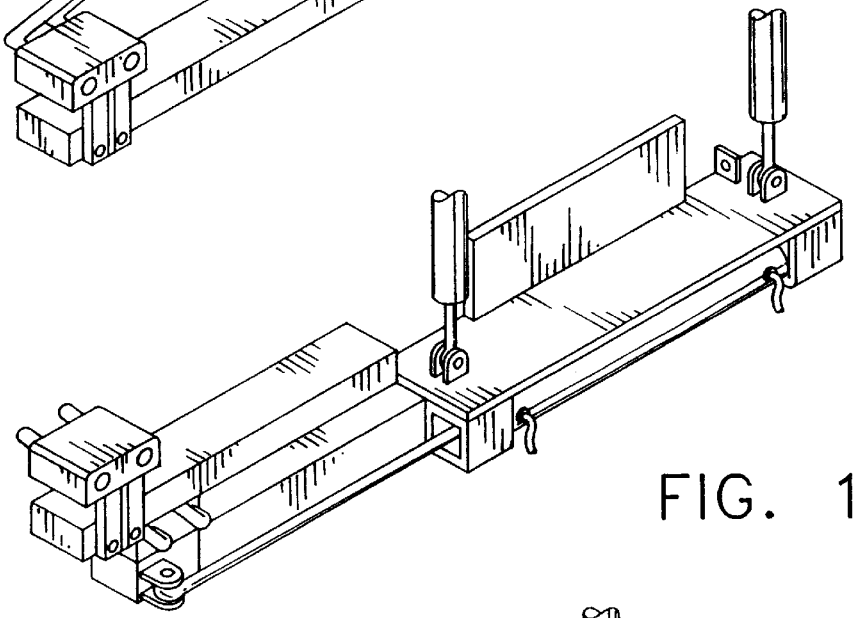
Figure 20:
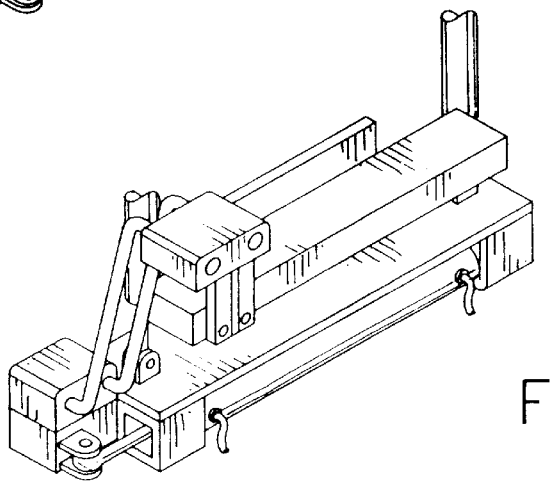
Figure 21:
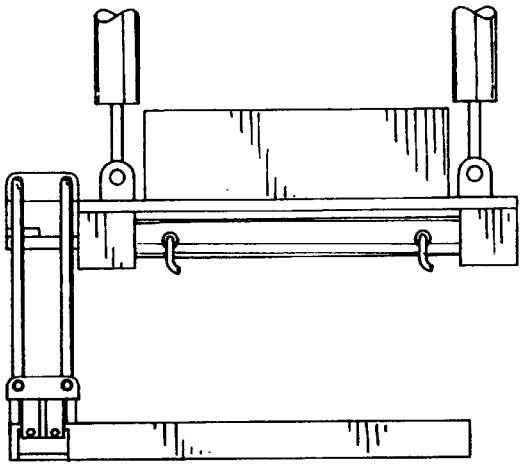
FIG. 21–25 are side views illustrating the rotation of the parallelogram support assembly through a tie pick-up and loading cycle.
Figure 22:
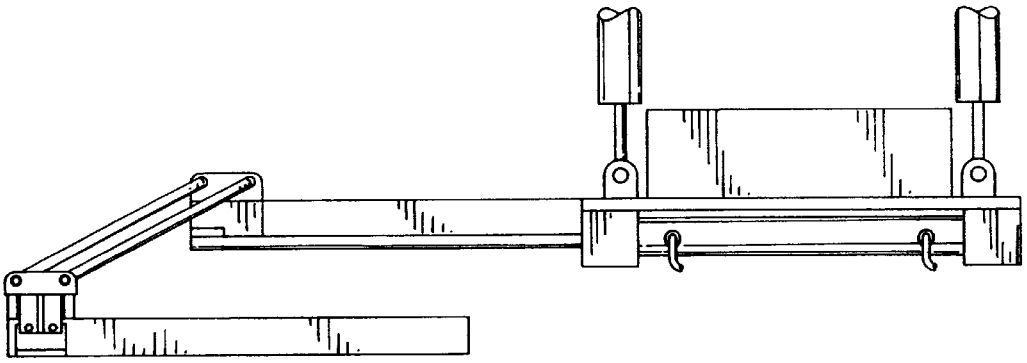
Figure 23:
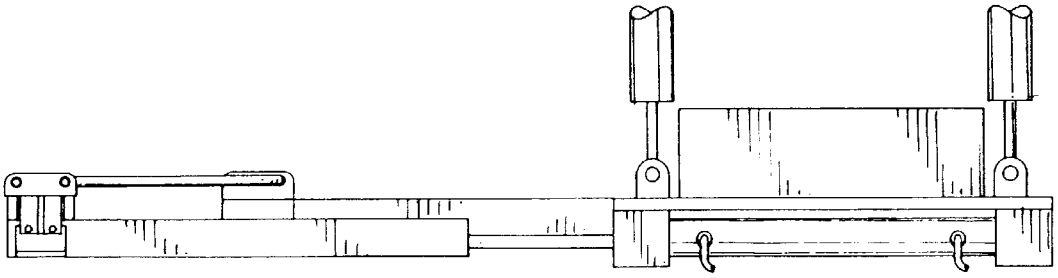
Figure 24:
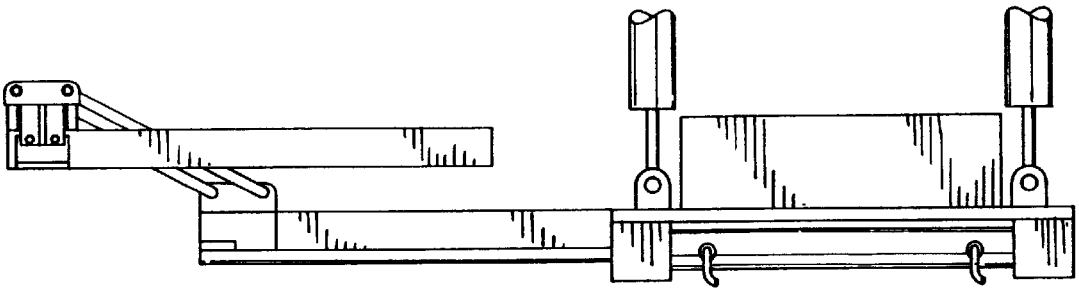
Figure 25:
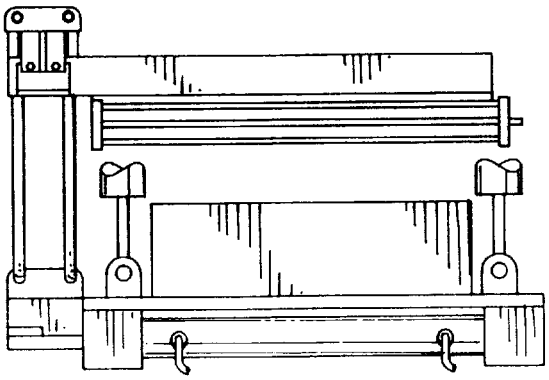

As shown in FIGS. 15 and 1SA, the parallelogram linkage 234 is connected to the top of clamping assembly 240 by a mount housing 236. The mount housing 236 is welded or otherwise connected to the top of connecting lugs 246A and 246B so that housing 236 encases the hydraulic cylinder 260 that operates the clamp jaws as discussed above. In addition, clamp assembly 240 is modified so that mounting plate 254 is fixed to the rear of mount housing 236. Mount housing 236 includes apertures 238 for receiving the ends of parallelogram linkage arms 234, which can rotate in apertures 238 on the mount housing at one end and in drive base 266 on the end of outer beam 226. Drive base 266 can contain a rotational drive for one or both of arms 234, for example having a gear box assembly coupling a hydraulic motor to drive arms 234. An electric motor and/or a chain, belt or similar device is also possible for rotating the parallelogram linkage.

The full range of motion for the parallelogram linkage 234 and the outer beam 226 is illustrated in FIGS. 16–20 and FIGS. 21–25. Initially, beam 226 is retracted within support tube 208 and parallelogram linkage 234 is rotated so that clamp assembly 240 is aligned with the end of a tie 14. Clamp assembly 240 grips tie 14 and beam 226 is moved in an outward direction from support tube 208 pulling tie 14 from underneath the rails 18. Parallelogram linkage 234 is then rotated to raise tie 14 to the height of the first level 114A of the combined car 100 (FIG. 2). The outer beam 226 is retracted during or after rotation, and the clamp assembly 240 opens to release tie 14 on tie collecting conveyor 108, on the first level 114A of combined car 100.

As successive ties 14 are extracted and lifted onto tie collection conveyor 108, the ties are transported via a conveyor 112 into a temporary tie storage compartment 106 located at the front section 116 of car 100. As worn ties are removed and stored, new ties 16 are loaded and transported using conveyor 110 on second level 114B to the rear of car 100, where they are unloaded to await insertion under rails 18. As new ties 16 are unloaded the tie transporter pick-up collected worn ties 14 from compartment 106 and transport them for storage in old tie storage car 60.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. A railway vehicle for the collection of worn railway ties and the distribution of new railway ties, comprising:

a first car having a tie distribution means and a second car having at least one tie loading apparatus;

at least one storage car, including a storage container with an open top and lateral flanges;

a continuous guide track comprising guide rails mounted along the lateral flanges, said guide rails extending longitudinally along and spanning between said at least two cars;

a tie collection basket comprising at least two downwardly extending U-shaped cross members suspended between a first and a second longitudinally extending member for supporting the ties, the tie collection basket being movable and dimensioned to rest on a portion of said lateral flanges for supporting said basket at a chosen longitudinal position in said at least one storage car; and, at least one of a tie loading vehicle and a tie transport vehicle, having flanged wheels permitting travel along said guide rails.

2. The railway vehicle of claim 1, wherein said tie distribution means comprises a conveyor belt which transfers new ties from a new tie collection area to a discharge area where the new ties are distributed along the rails.

3. The railway vehicle of claim 1, wherein said tie loading apparatus comprises a tie collection cage located on the front of said second car at track level, said cage capturing previously extracted ties from the rails and transferring the extracted ties to a conveyor belt which moves the extracted ties from said cage to a tie collection area.

4. The railway vehicle of claim 1, wherein said at least one storage car comprises a plurality of gondola cars with substantially rectangular frames having an open top at least laterally bounded by the flanges.

5. The railway vehicle of claim 1, wherein said continuous guide track comprises guide Sails extending along and spanning between at least two storage cars for movably supporting the at least one of said tie loading vehicle and said tie transport vehicle, said guide-rails of a first of said storage cars being linked to said guide rails of a second of said storage cars by an intermediate guide rail piece hingeably attached to said storage cars and extending telescopically across a gap between the storage cars.

6. The railway vehicle of claim 1, comprising said tie loading vehicle and said tie transport vehicle, the tie loading vehicle comprising a crane arm movable over a vertical span and a horizontal span by at least one hydraulic drive cylinder, said crane arm having a tie grapple dimensioned to grip and manipulate single and multiple ties.

7. The railway vehicle of claim 1, comprising said tie loading vehicle and said tie transport vehicle, the tie transport vehicle comprising a vertically movable bundle grapple operable by a hydraulic drive cylinder, the bundle grapple being dimensioned to engage and carry a plurality of ties in a bundle.

8. A railway vehicle for the extraction and collection of worn railway ties and the distribution of new railway ties, comprising:

a first car having a tie distribution means and a second car having at least one tie extraction and loading apparatus;

at least one storage car, including a storage container with an open top and lateral flanges;

a continuous guide track comprising guide rails mounted along the lateral flanges, said guide rails extending longitudinally along and spanning between said at least two cars;

a tie collection basket comprising at least two downwardly extending U-shaped cross members suspended between a first and a second longitudinally extending member for supporting the ties, the tie collection basket being movable and dimensioned to rest on a portion of said lateral flanges for supporting said basket at a chosen longitudinal position in said at least one storage car; and, at least one of a tie loading vehicle and a tie transport vehicle, having flanged wheels permitting travel along said guide rails and being operable for at least one of moving, loading and unloading.

9. The railway vehicle of claim 8, wherein said tie distribution means comprises a conveyor belt which transfers new ties from a new tie collection area to a discharge area where the new ties are distributed along the rails.

10. The railway vehicle of claim 8, wherein said tie loading means comprises:

a first extensible beam telescopically received within a support tube attached to an adjustable support frame for supporting said beam in a substantially horizontal orientation under said second car, said support frame being selectively adjustable to position said beam relative to a tie to be removed;

a linkage coupled to a distal end of said extensible beam, the linkage having parallel arms with one end thereof rotatably mounted in the rotational actuator;

a tie gripper having a mount housing carried on an opposite end of the parallel arms and a clamp for selectively gripping a railway tie; and, powered actuators coupled to close the clamp for gripping the tie, to extend the beam for substantially horizontally extracting the tie, to rotate the linkage for lifting the tie in a substantially horizontal orientation, and to retract the beam for positioning the tie at a collection point in the second car.

11. The railway vehicle of claim 8, wherein said at least one storage car comprises gondolas having rectangular frames with open tops, the flanges being located around edges of the tops and supporting the guide rails.

12. The railway vehicle of claim 8, wherein said continuous guide track comprises guide rails extending along and spanning between at least two storage cars for movably supporting the at least one of said tie loading vehicle and said tie transport vehicle, said guide rails of a first of said storage cars being linked to said guide rails of a second of said storage cars by an intermediate guide rail piece hingeably attached to said storage cars and extending telescopically across a gap between the storage cars.

13. The railway vehicle of claim 8, comprising said tie loading vehicle and said tie transport vehicle, the tie loading vehicle comprising a crane arm movable over a vertical span and a horizontal span by at least one hydraulic drive cylinder, said crane arm having a tie grapple dimensioned to grip and manipulate single and multiple ties.

14. The railway vehicle of claim 8, comprising said tie loading vehicle and said tie transport vehicle, the tie transport vehicle comprising a vertically movable bundle grapple operable by a hydraulic drive cylinder, the bundle grapple being dimensioned to engage and carry a plurality of ties in a bundle.

15. The railway vehicle of claim 8, wherein said tie collection basket is dimensioned to fit on an inner portion of the lateral flanges of said at least one storage car, at any selected longitudinal position along the flanges, for one of accumulation and temporary storage of ties.

16. A method of exchanging worn ties with new ties using a rail carried railway maintenance vehicle with a plurality of tie storage cars having an upper guide rail for supporting flange wheeled vehicles for movement over the storage cars, comprising the steps of:

collecting worn ties at a first part of the vehicle and accumulating the worn ties at a collection point on the vehicle, using at least one of a tie collection basket, a conveyor, a crane and a movable tie extractor;

transporting the worn ties using a first transport vehicle having flanged wheels and operating on the guide rail, and moving the worn ties from the collection point to a next available area of the tie storage cars, such that the worn ties are progressively stored at a longitudinally changing position in the storage cars;

simultaneously with said collecting and transporting of the worn ties using the first transport vehicle, loading new ties using a second transport vehicle having flanged wheels and operating on the guide rail, from a supply of new ties in the storage cars, proceeding to remove the new ties progressively from a longitudinally changing position in the storage cars;

locating a movable temporary storage basket at an intermediate longitudinal position along the storage cars, storing a quantity of one of the worn ties and the new ties in the temporary storage basket, and transferring said quantity with one of the first and second transport vehicles for shortening a longitudinal range of travel required of said one of the first and second transport vehicles.

17. The method of claim 16, wherein the quantity of ties is transferred between the temporary storage basket and one of said longitudinal positions of storing and removal, by a third vehicle.

* * * * *

UNITED STATES PATENT AND TRADEMARK OFFICE

CERTIFICATE OF CORRECTION

PATENT NO. : 6,089,162
DATED : July 18, 2000
INVENTOR(S) : Harry Madison

It is certified that error appears in the above-identified patent and that said Letters Patent is hereby corrected as shown below:

Title page,
ABSTRACT,
Line 5, "the-track" should read -- the track --,

Column 2,
Line 8, "Theutr" should be -- Theurer --,

Column 6,
Line 35, "Are" should be -- are --,

Column 10,
Line 8, "1SA" should be -- 15A --,

Column 11, claim 5,
Line 26, "Sails" should be -- rails --; and
Line 29, "guide-rails" should be -- guide rails --.

Signed and Sealed this

Twenty-ninth Day of January, 2002

*Attest:*

*Attesting Officer*

JAMES E. ROGAN
*Director of the United States Patent and Trademark Office*